US007267085B2

(12) United States Patent
Joyce et al.

(10) Patent No.: US 7,267,085 B2
(45) Date of Patent: Sep. 11, 2007

(54) METHOD OF ENGINE COOLING

(75) Inventors: Steven Joyce, Surrey (GB); Iain William Gouldson, Essex (GB); Chris Bush, Essex (GB); Noel Henderson, Chipping Ongar (GB); Christian Brace, Bath (GB)

(73) Assignee: Visteon Global Technologies, Inc., Van Buren Township, MI (US)

( * ) Notice: Subject to any disclaimer, the term of this patent is extended or adjusted under 35 U.S.C. 154(b) by 0 days.

(21) Appl. No.: 11/387,039

(22) Filed: Mar. 22, 2006

(65) Prior Publication Data

US 2006/0288967 A1 Dec. 28, 2006

(30) Foreign Application Priority Data

Mar. 22, 2005 (GB) ..... 0505843.3

(51) Int. Cl.

| | |
|---|---|
| ***F01P 7/14*** | (2006.01) |
| ***F01P 7/02*** | (2006.01) |
| ***F01P 5/10*** | (2006.01) |
| ***G06F 19/00*** | (2006.01) |

(52) U.S. Cl. ..... 123/41.08; 123/41.12; 123/41.44; 701/36

(58) Field of Classification Search ..... 123/41.08, 123/41.09, 41.1, 41.11, 41.12, 41.44; 701/36
See application file for complete search history.

(56) References Cited

U.S. PATENT DOCUMENTS

| | | | | |
|---|---|---|---|---|
| 5,910,099 | A | 6/1999 | Jordan, Jr. et al. | |
| 6,109,219 | A | 8/2000 | Sano | |
| 6,178,928 | B1 | 1/2001 | Corriveau | |
| 6,253,716 | B1 | 7/2001 | Palmer et al. | |
| 6,308,664 | B1 | 10/2001 | Ambros | |
| 6,374,780 | B1 | 4/2002 | Rutyna et al. | |
| 6,591,174 | B2 * | 7/2003 | Chung et al. | 701/36 |
| 2002/0016656 | A1 | 2/2002 | Chung et al. | |

* cited by examiner

*Primary Examiner*—Noah P. Kamen
(74) *Attorney, Agent, or Firm*—Brinks Hofer Gilson & Lione

(57) ABSTRACT

This invention relates to a method of cooling an engine for an automobile. The method operates using a predictive, feed-forward element combined with a fuzzy logic feedback controller to achieve accurate control over engine temperature. The fuzzy logic feedback is only utilized in the event that the predictive control results in a cylinder head temperature outside a predetermined range.

11 Claims, 6 Drawing Sheets

METHOD OF ENGINE COOLING

BACKGROUND

1. Field of the Invention

This invention relates to a method of cooling an engine for an automobile.

2. Related Technology

In a typical motor vehicle cooling circuit, coolant passes through a jacket surrounding the vehicle engine and its temperature rises. It then passes through the radiator, entering the radiator through a manifold and then passing through cooling tubes where air flows over the tubes to remove heat from and to reduce the temperature of the coolant before the coolant is re-circulated via a second manifold to the vehicle engine.

Cooling systems generally have a coolant pump for pumping coolant through the engine coolant circuit. A valve is conventionally provided to prevent coolant circulating through the radiator while the engine is warming up. The cooling system usually includes a fan for blowing air over the radiator in the event that the coolant becomes too hot in situations where the speed of the automobile does not provide the necessary cooling air flow over the radiator.

Known methods of cooling engines usually include controls based on output of a thermostatic device for opening and closing the valve and for switching the fan on and off. The speed of the water pump is generally operated in dependence upon the engine speed.

Such known systems use feedback from sensors in order to control the valve, the fan and the water pump. The emission levels and fuel economy achieved by an engine is known to be directly related to the operating temperature of the engine. An optimum temperature can be identified for any given engine; running the engine at this temperature for prolonged periods of time will result in reduced emissions and improved fuel economy.

However, due to the interactive nature of the individual system components it is possible to reject a given quantity of heat in a number of different ways. Ideally the components would controlled to optimize power consumption as well as emissions and fuel consumption.

The problem with known systems is that it is difficult to operate the engine at an optimum temperature in order to optimize emissions, while also optimizing fuel consumption and power consumption. Furthermore, traditional controllers such as proportional-integral-derivative (PID) controllers are based on comparing a measured value with a desired value (an error based approach) and calculates proportion, integrals and/or derivatives of the error in order to provide an adjusted input value. This approach requires large amounts of processor power and memory. Furthermore it assumes that the system being modeled is linear, or behaves as a monotonic function.

A simpler controller is sought which uses less system resources.

SUMMARY

This invention seeks to alleviate the aforementioned problems, and the proposed system operates using a predictive, feed-forward element combined with a fuzzy logic feedback controller to achieve accurate control over engine temperature with minimal controller effort and dynamic instability.

The controller of this invention utilizes a fuzzy logic controller to effectively control the feedback element of the strategy. A fuzzy logic controller operates using a number of logic based rules (IF X AND Y THEN Z, for example) rather than attempting to model a system mathematically. These are used in combination with a set of output membership functions used to define the system responses based on the value of the desired inputs. For example, rather than dealing with temperature control in terms such as "SP=500 F", "T<1000 F", or "210 C <TEMP <220 C", terms such as "IF (process is too cool) AND (process is getting colder) THEN (add heat to the process)" or "IF (process is too hot) AND (process is heating rapidly) THEN (cool the process quickly)" are used. These terms are imprecise and yet very descriptive of what must actually happen.

Due to the discrete nature of a fuzzy logic system, the system memory usage (both storage (read only memory) and processing (random access memory)) levels are considerably reduced when compared to a conventional PID controller.

Typically fuzzy logic controllers are used as predictive feed-forward controllers.

According to the invention there is provided a method of regulating the temperature of an engine for an automobile having a radiator, a coolant pump, a coolant fan and a coolant flow regulating valve, the method comprising the steps of:

a) determining a required radiator heat rejection;

b) determining a required engine cylinder head temperature;

c) determining a first pump speed, a first fan speed and a first valve position in dependence upon the required heat rejection and a radiator simulation model;

d) determining a cylinder head temperature error in dependence on a measured cylinder head temperature and the required cylinder head temperature; in the event that the error is outside a predetermined range e) determining a pump speed modifier, a fan speed modifier and a valve position modifier in dependence upon fuzzy logic rules;

f) setting the fan speed in dependence upon the first fan speed and the fan speed modifier;

g) setting the pump speed in dependence upon the first pump speed and the pump speed modifier; and h) setting the valve position in dependence upon the first valve position and the valve position modifier; and in the event that the error is within the predetermined range i) setting the fan speed in dependence upon the first fan speed;

j) setting the pump speed in dependence upon the first pump speed; and k) setting the valve position in dependence upon the first valve position.

Preferably the determining step c) comprises the sub-steps of: in the event that the valve is set at a predetermined maximum opening position, determining the first pump speed and first fan speed according to data stored in a first database; in the event that the valve is not set at the predetermined maximum opening position determining the first pump speed and the first valve position according to data stored in a second database.

In a preferred embodiment the data in the first database and in the second database is predetermined using a radiator performance model.

Preferably, the required radiator heat rejection is generated at step a) in dependence upon the heat generated by the engine less the heat dissipated by heat sinks.

In one embodiment the heat sinks are auxiliary heaters, an exhaust gas recirculation unit, an oil cooler and/or a cabin heater.

The data in the first database may be generated by repeating the steps: choosing a fan speed; determining the required coolant flow according to the radiator performance model; and determining the corresponding pump speed; until an optimum fan and pump speed have been found.

The data in the second database may be generated by the steps of determining the required coolant flow according to the radiator performance model; and repeating the step of choosing a valve position and determining the corresponding pump speed until an optimum valve position and pump speed have been found.

BRIEF DESCRIPTION OF THE DRAWINGS

An embodiment of the invention will now be described, by way of example only, with reference to the accompanying drawings, in which.

DETAILED DESCRIPTION OF THE INVENTION

Figure 1:
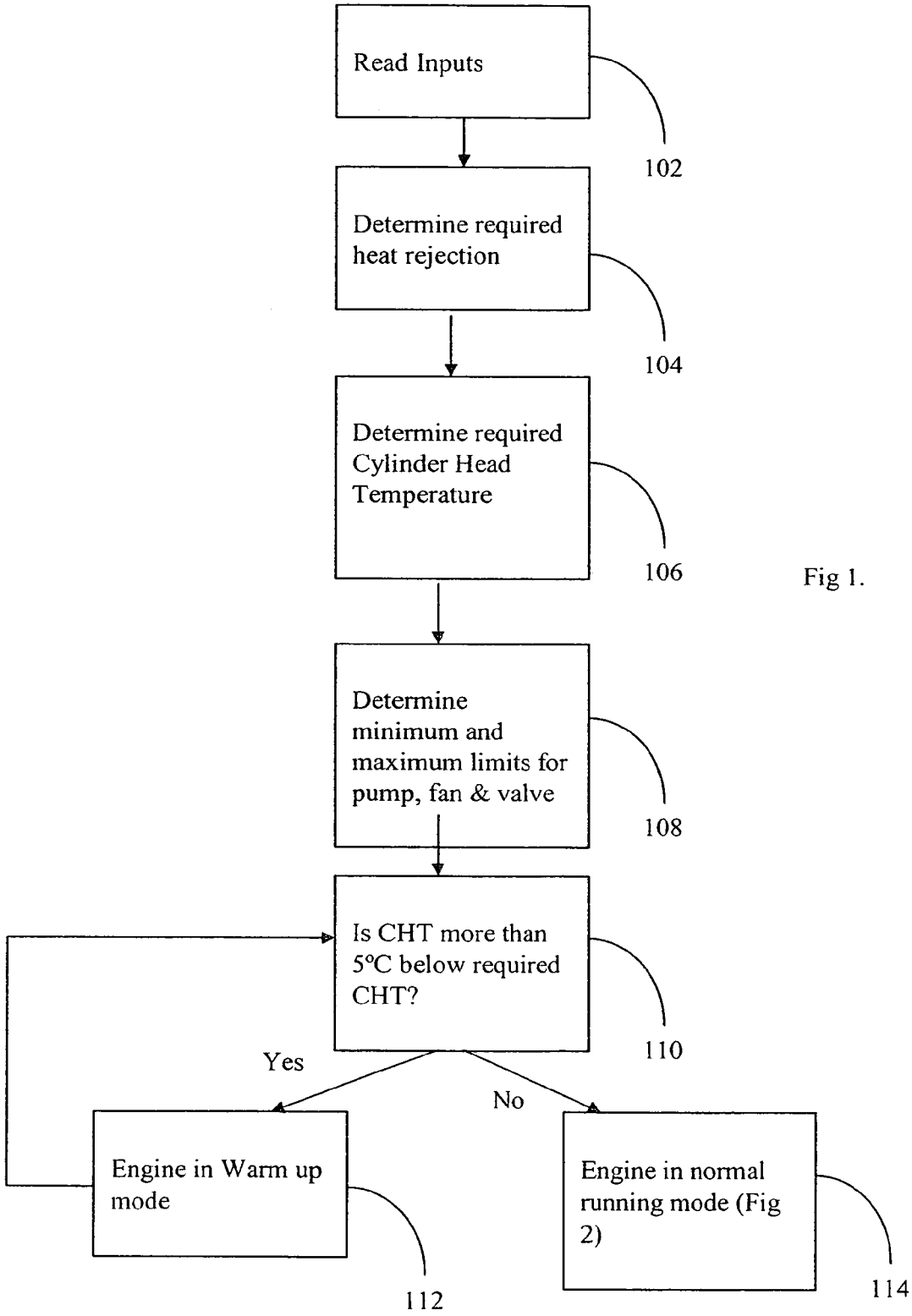
FIG. 1 is a flow chart illustrating initial steps in a method of regulating the temperature of an automobile.

Referring firstly to FIG. 1, at step 102 the values of various external inputs are read for use by the method. Various inputs are read from an engine control unit (ECU) for example the following values may be provided by the ECU:

| Description | Value Range |
|---|---|
| Engine Speed | 0-6500 rpm |
| Throttle Position | 0-100% |
| Cylinder Head Temperature (CHT) | −40-320° C. |
| Vehicle Speed | 0-255.99 km/hr |
| Fuel Demand | 0-225 mg/stroke |
| Ignition State | 0/1/2 (Off/Run/Crank) |
| AC Required | 0-1 (On/Off) |
| Ambient Air Temperature (AAT) | −40-320° C. |
| Manifold Air Pressure (MAP) | 0-1500 kpa |
| Charge Air Temperature (ACT) | −40-250° C. |
| Exhaust Gas Recirculation (EGR) Valve Position | 0-10.0 mm valve lift |
| Idle Speed Fuel Demand | 0-255.99 mg/stroke |
| Intake Mass Air Flow (MAF) | 0-20 kg/second |

Some input variables are taken directly from analogue sensors located throughout the vehicle, for example:

| Description | Value Range |
|---|---|
| Heater/Ventilation/Air Conditioning (HVAC) Setting | Cold/warm/hot |
| Heater/Air Con Blower Speed | 0-100% |
| Engine Inlet Coolant Temperature (EIT): | −40-150° C. |

-continued

| Description | Value Range |
|---|---|
| Coolant Control Valve Inlet Coolant Temperature (VIT): | −40-150° C. |
| Engine Sump Oil Temperature (SOT): | −40-150° C. |
| Coolant Control Valve Positional Feedback (VPFB) | 0-200° |

Some of the input variables are subjected to low pass filtering in order to remove transient spikes and noise.

At step 104 the required heat rejection is calculated. All cooling system heat sources and sinks are evaluated, therefore establishing the level of residual heat left within the coolant system. The sum of all sources and sinks determines the required radiator heat rejection.

The heat generated by the engine, $Q_{eng}$, is determined using the relationship:

$$Q_{eng}=K\times\text{Engine Speed}^{A}\times\text{Engine Load}^{B}$$

$$\text{Engine Load}=f\{\text{Engine Speed, Throttle Position, Fuel Demand}\}$$

Where constants A, B and K are derived using experimental data for a given engine.

The heat used by auxiliary heaters, $Q_{aux}$, is dependent upon the Cylinder Head Temperature (CHT) and the Ambient Air Temperature (AAT):

$$Q_{aux}=f\{\text{CHT, AAT}\}.$$

The exhaust gas recirculation (EGR) cooler contributes to heat rejection by an amount $Q_{EGR}$ in dependence upon the exhaust gas flow and the coolant flow and upon the difference between the exhaust gas temperature and the valve inlet temperature:

$$Q_{EGR}/\text{ETD}_{EGR}=K\times\text{gas_flow}^{A}\times\text{coolant_flow}^{B}$$

$$\text{ETD}_{EGR}=T_\text{exhaust}-\text{VIT}$$

Where "Gas_flow" is dependent upon the EGR valve position, "Coolant_flow" is dependent upon Engine Speed and VPFB, "T_exhaust" is dependent upon engine load, engine speed and AAT, and "ETD" stands for Extreme Temperature Difference.

Again constants A, B and K (which are different from those constants mentioned above) are determined using experimental data.

The oil cooler contributes to heat rejection by an amount $Q_{OC}$, in dependence upon the rate of coolant flow and the rate of oil flow, and upon the difference between the engine sump oil temperature (SOT) and the engine inlet coolant temperature (EIT):

$$Q_{OC}/\text{ETD}_{OC}=K\times\text{oil_flow}^{A}\times\text{cool_flow}^{B}$$

$$\text{Oil_flow}=f\{\text{Engine Speed}\}$$

$$\text{ETD}_{OC=SOT-EIT}$$

The heater cabin contributes to heat rejection by an amount $Q_{HC}$ in dependence upon the air flow across the heater and the difference between the coolant control valve inlet coolant temperature (VIT) and the ambient air temperature (AAT).

$$Q_{HC}/\text{ETD}_{HC}=K\times\text{air_flow}^{A}\times\text{cool_flow}^{B}$$

$$\text{ETD}_{HC}=\text{VIT}-\text{AAT}$$

Air_flow is heatercore air flow and is dependent upon the Heater/Air Con blower speed.

Again constants A, B and K (different from those above) are determined using experimental data.

At step 106 the required cylinder head temperature (CHT) is determined as a function of engine speed and engine load.

At step 108 the limits of operation of the fan, pump and valve are calculated.

The minimum speed of the fan is set in dependence upon the air conditioning requirement. If air conditioning is required, then the fan speed minimum is set to stationary air-conditioning requirements. If the vehicle speed exceeds the required fan speed, then the fan is deactivated, i.e. the maximum speed is set to 0 RPM.

The pump range is dependent upon a predefined maximum engine temperature, CHT and engine inlet temperature. The pump speed minimum is set to allow a minimum "coolant_flow" in dependence upon $Q_{eng}$ and the predefined maximum engine temperature The HVAC setting is used to determine a minimum and maximum heater flow to avoid over pressurizing the heater core. Current data suggests that satisfactory heater performance can be obtained using 15-30 liters/min heater flow.

The valve range (degrees rotation) is dependent upon heater flow, oil flow and minimum coolant flow. These are used determine valve min/max angular positions.

If the measured CHT is more than 5° below the required CHT at step 110 then the engine is in warm up mode. In this case at step 112 the pump speed, fan speed and valve opening are all set to the minimum values determined at step 108 until the difference between the required CHT and the measured CHT (CHR error) is less than 5°. Once the CHT is within this range the engine is in normal operating mode, and the open loop controller illustrated by FIG. 2 is initiated.

Figure 2:
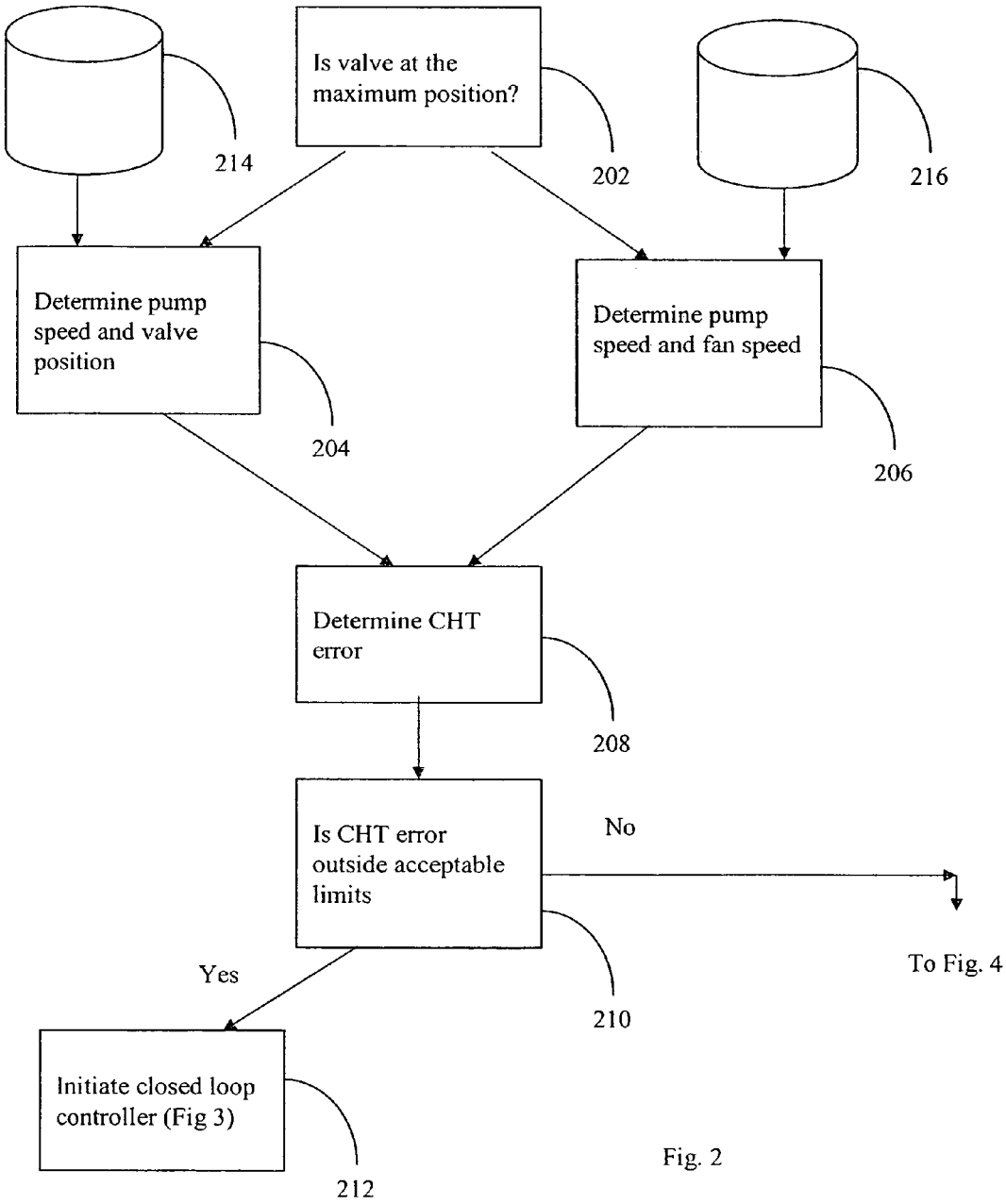
FIG. 2 is a flow chart illustrating steps used to determine pump speed, fan speed and valve position according to the present invention.

Referring now to FIG. 2, a first pump speed, first fan speed and first valve position are determined.

At step 202 the valve positional feedback is used to compare the current valve position to the maximum valve position determined at step 108. If the valve is not already at its maximum opening position then a first pump speed and first valve position are determined at step 204 by reference to lookup table 214. The first fan speed is set to be equal to the minimum level determined at step 108.

If the valve position is already at its maximum opening position at step 202 then at step 206 a first pump speed and first fan speed are determined which reject the required amount of heat while using the least amount of electrical power by reference to lookup table 216. The first valve position is set to be equal to the maximum opening position determined at step 108.

Figure 2A:
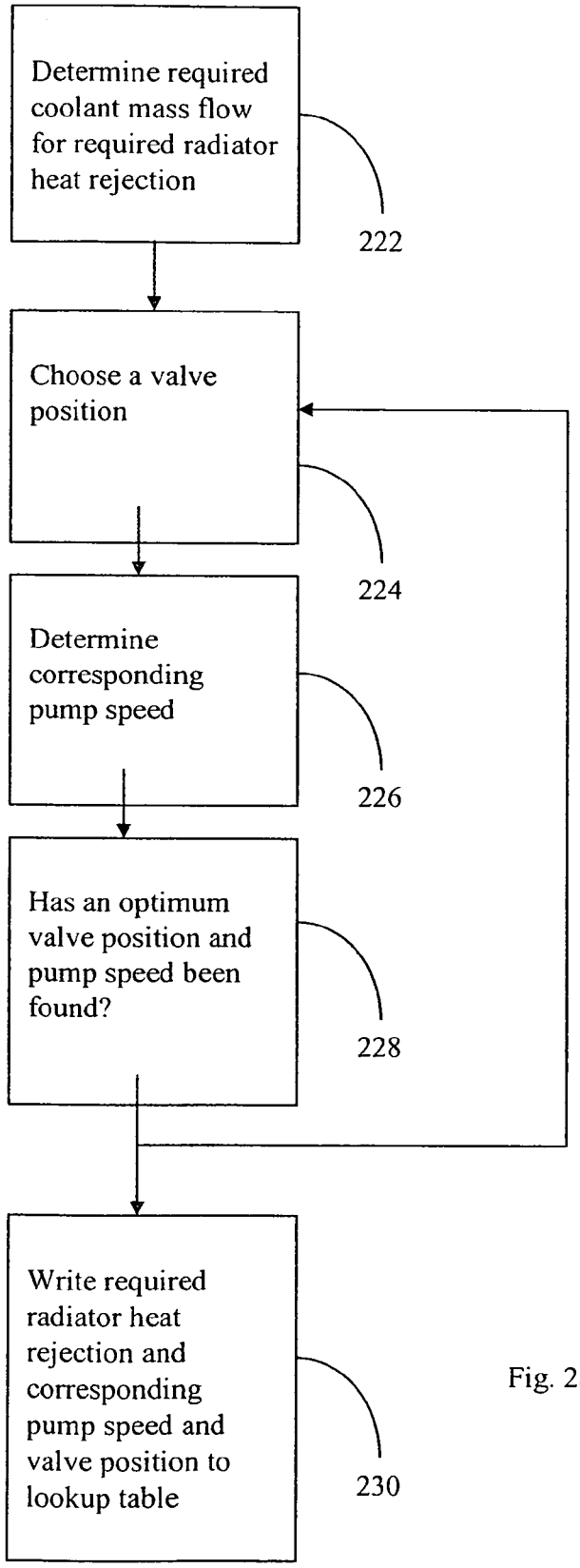
FIGS. 2*a* and 2*b* are flow charts illustrating generation of a lookup tables.
Figure 2B:
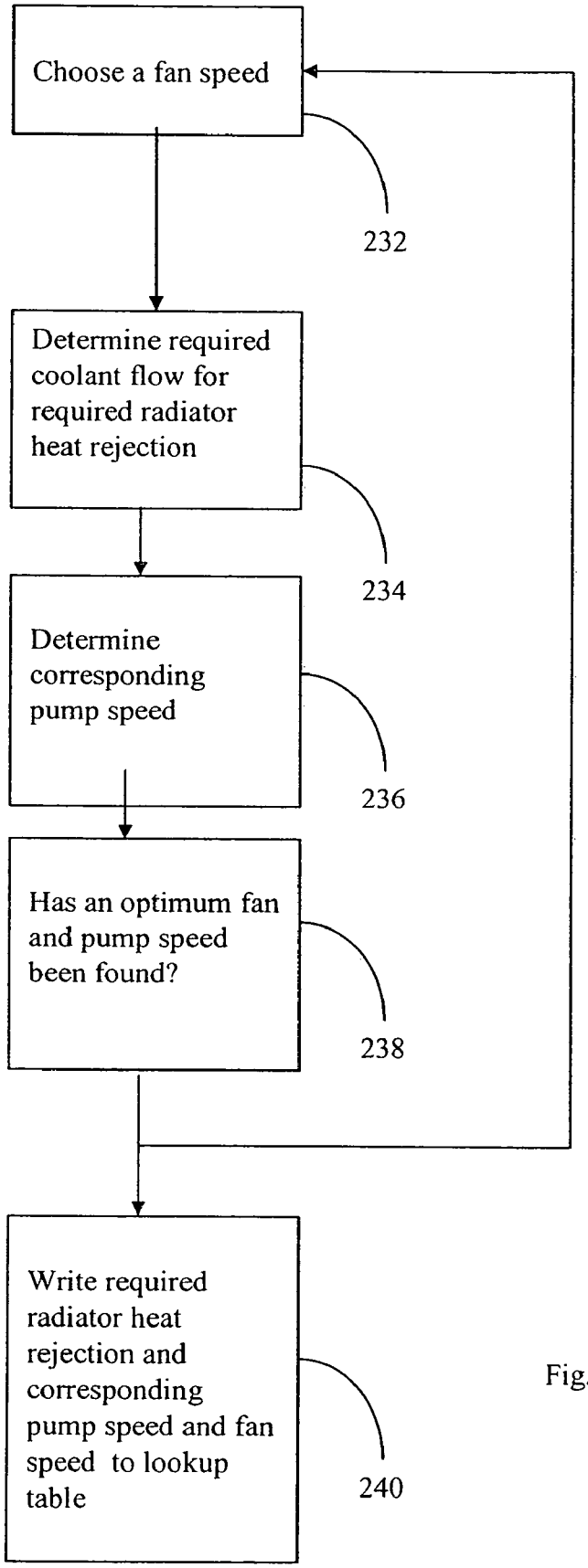
Figure 3:
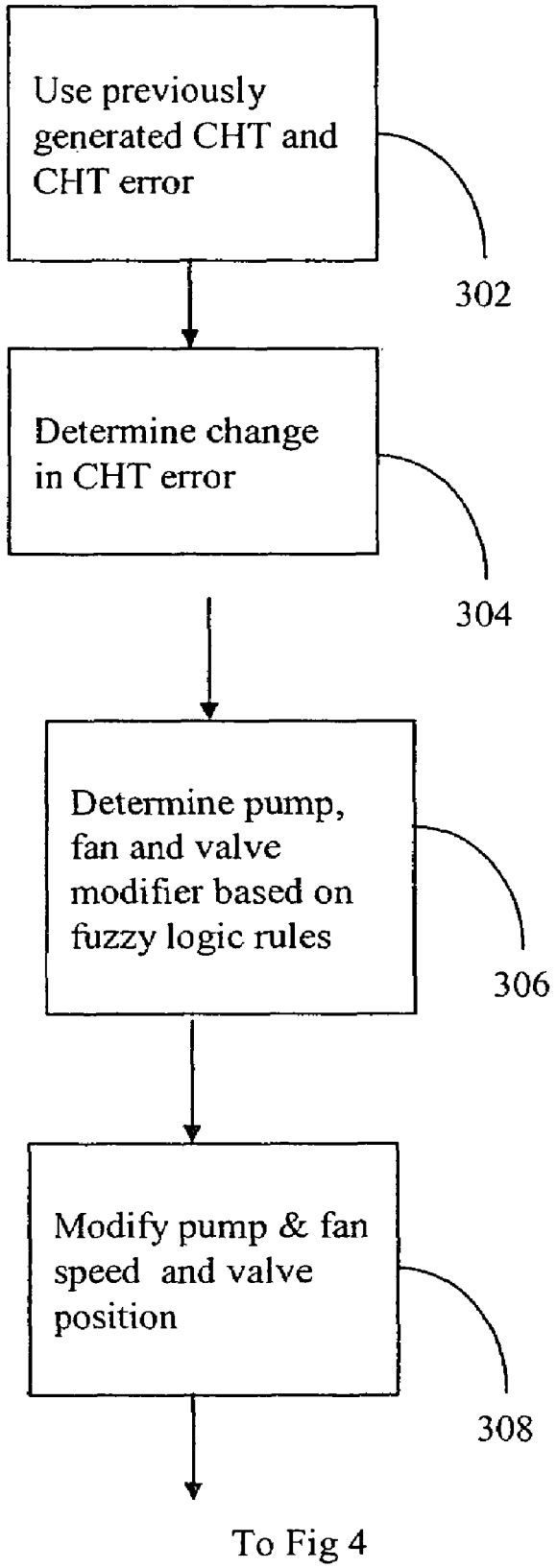
FIG. 3 is a flowchart illustrating steps used to determined modified pump speed, fan speed and valve position, in the event that temperature remains outside acceptable limits after the steps illustrated in FIG. 2.

The lookup tables 214, 216 are generated offline using an engine simulator and an optimization routine as illustrated in FIG. 2*a* and FIG. 2*b*.

Referring now to FIG. 2*a*, the optimizer routine for generating the lookup table 214 for use by step 204 will now be described.

A radiator performance model is used to determine the required coolant flow to achieve the required heat rejection using the following relationships.

$$q_{cool}=(Q_{rad}/(\mathrm{ETD}_{RAD}\times K\times q_{air}^{A}))^{1/B}$$

$$\mathrm{ETD}_{RAD}=\mathrm{VIT}-\mathrm{AAT}$$

$$Q_{rad}=Q_{eng}-Q_{aux}-Q_{EGR}-Q_{OC}-Q_{HC}.$$

$$q_{air}=f\{\text{Fan speed, Radiator cross sectional Area, Ambient Air Temperature}\}$$

Constants A B and K are determined by results of a radiator simulation.

At step 222 a required coolant flow is determined using the above equations.

A valve position is chosen at step 224 and at step 226 the pump speed required to obtain the required coolant flow at the chosen valve position is determined using a lookup table.

Steps 224 and 226 are repeated until an optimum position using minimum power is found at step 228.

The valve position chosen at step 224 is increased and decreased by a step size which is determined by an algorithm which increases the step size if the valve position and pump speed are a long way from an optimum point and which decreases the step size when the valve position and pump speed are close to an optimum.

At step 230 the required radiator heat rejection is written to the lookup table 214 along with the associated optimum valve position and pump speed.

The optimizer routine for generating the lookup table 216 for use by step 206 will now be described with reference to FIG. 2*b*.

At step 232 a fan speed is chosen, and at step 234 a required coolant mass flow is determined using the radiator simulator model described above.

At step 226 the pump speed required to obtain the required coolant mass flow at the chosen valve position is determined using a lookup table.

Steps 234,236 and 238 are repeated until an optimum point is found at step 238. An optimum is determined based on the total power requirement of the pump and the fan.

The fan speed chosen at step 232 is increased and decreased by a step size which is determined by an algorithm which increases the step size if the fan speed and pump speed are a long way from an optimum point and which decreases the step size when the fan speed and pump speed are close to an optimum.

At step 240 the required radiator heat rejection is written to the lookup table 214 along with the associated optimum fan speed and pump speed.

Referring back not to FIG. 2, once the fan speed, pump speed and valve position have been determined and set, the CHT error is measured. If the CHT error is not within acceptable predetermined limits then a closed loop controller using fuzzy logic rules is initiated at step 212.

Figure 4:
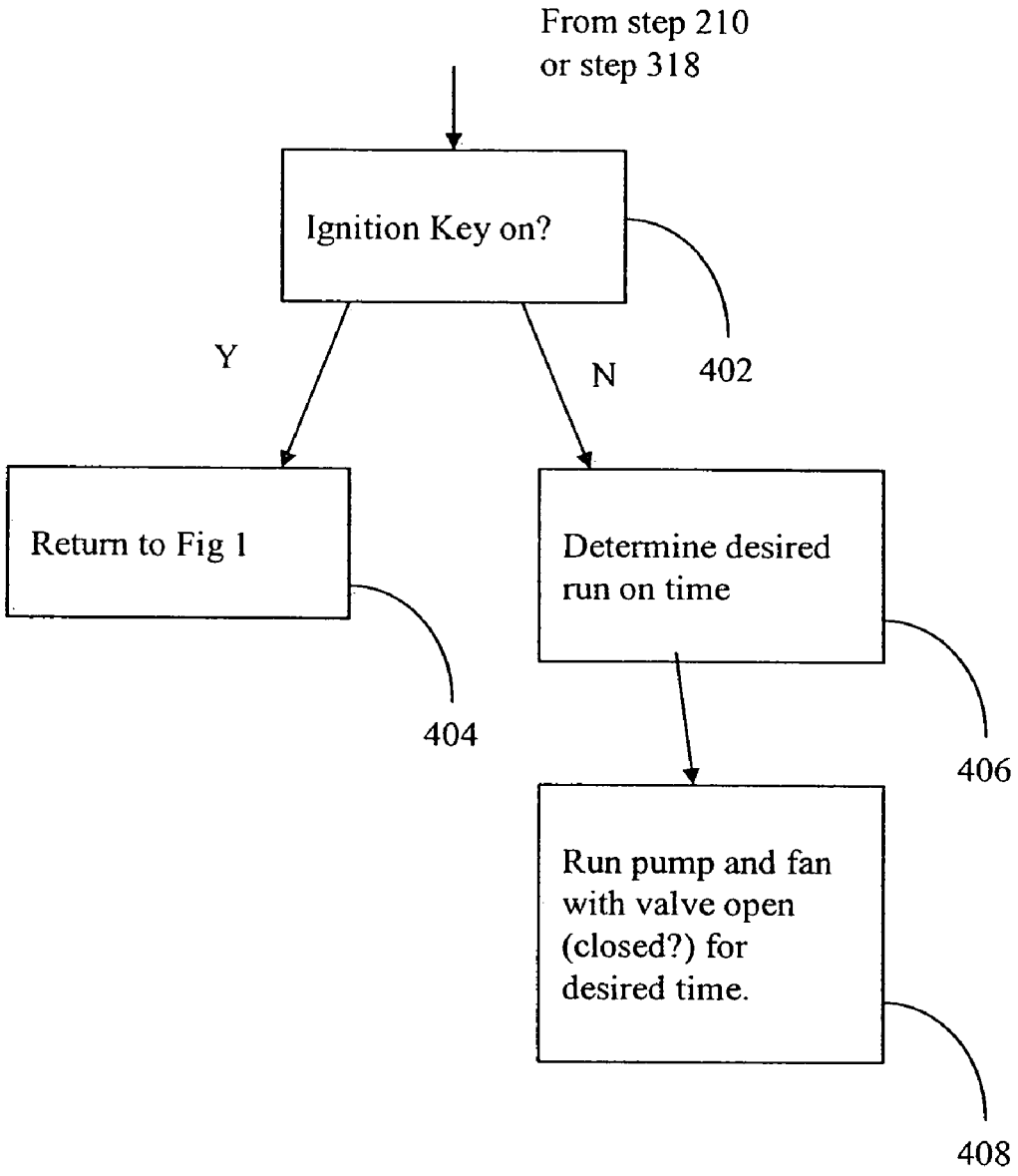
FIG. 4 is a flow chart illustrating the steps performed after the engine is switched off.

Referring now to FIG. 4, at step 302 the required CHT and the CHT error are used from previous steps 106 and 208 and at step 305 the change in CHT error is determined.

At step 306 a pump speed modifier, a fan speed modifier and a valve position modifier are calculated using the following fuzzy logic rules:

| CHT error | Change in CHT error | Valve position modifier | Pump speed modifier | Fan speed modifier |
|---|---|---|---|---|
| H+ | H− | 0 | 0 | 0 |
| L+ | H− | H− | H− | H− |
| H− | H− | H− | H− | H− |
| L− | H− | H− | H− | H− |
| H+ | H+ | H+ | H+ | H+ |
| L+ | H+ | L+ | L+ | L+ |
| H− | H+ | 0 | 0 | 0 |
| L− | H+ | L+ | L+ | L+ |
| H+ | L− | L+ | L+ | L+ |
| L+ | L− | 0 | 0 | 0 |
| H− | L− | H− | H− | H− |
| L− | L− | H− | H− | H− |
| H+ | L+ | H+ | H+ | H+ |

-continued

| CHT error | Change in CHT error | Valve position modifier | Pump speed modifier | Fan speed modifier |
|---|---|---|---|---|
| L+ | L+ | L+ | L+ | L+ |
| H− | L+ | H+ | H+ | H+ |
| L− | L+ | 0 | 0 | 0 |

H = large change
L = small change
+ = increase
− = decrease

For example the first row indicates that for a large hot CHT error and a large decrease in CHT error, all the modifiers will be set to 0.

Once the modifiers have been determined using the fuzzy logic rules, the modifiers are applied to the first fan speed, first pump speed and first valve position calculated at step 204 or 206.

Referring now to FIG. 4, whether or not the fuzzy logic closed loop controller is initiated by the decision at step 210, at step 402 the ignition signal and engine rpm is used to determine whether the engine is still running. If so, then the process resumes at step 102 (FIG. 1). If not, then a desired run on time is determined at step 406 in dependence upon $ETD_{RAD}$ (defined above as VIT−AAT). The pump and fan speed are then set at a predetermined value for the desired run on time at step 408.

It is to be recognized that various alterations, modifications, and/or additions may be introduced into the constructions and arrangements of parts described above without departing from the scope of the present invention as defined in the following claims.

The invention claimed is:

1. A method of regulating the temperature of an engine for an automobile having a radiator, a coolant pump, a coolant fan and a coolant flow regulating valve, the method comprising the steps of:

a) determining a required radiator heat rejection;

b) determining a required engine cylinder head temperature;

c) determining a first pump speed a first fan speed and a first valve position in dependence upon the required heat rejection and a radiator simulation model;

d) determining a cylinder head temperature error in dependence on a measured cylinder head temperature and the required cylinder head temperature;

in the event that said error is outside a predetermined range e) determining a pump speed modifier, a fan speed modifier and a valve position modifier in dependence upon fuzzy logic rules;

f) setting the fan speed in dependence upon the first fan speed and said fan speed modifier;

g) setting the pump speed in dependence upon the first pump speed and the pump speed modifier; and h) setting the valve position in dependence upon the first valve position and the valve position modifier; and in the event that said error is within said predetermined range i) setting the fan speed in dependence upon the first fan speed;

j) setting the pump speed in dependence upon the first pump speed; and k) setting the valve position in dependence upon the first valve position.

2. A method according to claim 1, in which the determining step c) comprises the sub steps of: in the event that the valve is set at a predetermined maximum opening position, determining the first pump speed and first fan speed according to data stored in a first database; and in the event that the valve is not set at said predetermined maximum opening position, determining the first pump speed and the first valve position according to data stored in a second database.

3. A method according to claim 2, in which data in the first database and data in the second database is predetermined using a radiator performance model.

4. A method according to claim 3 in which the data in the first database is generated by repeating the steps:

choosing a fan speed;

determining the required coolant flow according to the radiator performance model; and determining the corresponding pump speed;

until an optimum fan and pump speed have been found.

5. A method according to claim 3 in which the data in the second database is generated by the steps of:

determining the required coolant flow according to the radiator performance model; and repeating the step of choosing a valve position and determining the corresponding pump speed until an optimum valve position and pump speed have been found.

6. A method according to claim 3, in which the required radiator heat rejection is generated at step a) in dependence upon the heat generated by the engine less the heat dissipated by heat sinks.

7. A method according to claim 6, in which the heat sinks are one or more of auxiliary heaters, an exhaust gas recirculation unit, an oil cooler and a cabin heater.

8. A method according to claim 2, in which the required radiator heat rejection is generated at step a) in dependence upon the heat generated by the engine less the heat dissipated by heat sinks.

9. A method according to claim 8, in which the heat sinks are one or more of auxiliary heaters, an exhaust gas recirculation unit, an oil cooler and a cabin heater.

10. A method according to claim 1, in which the required radiator heat rejection is generated at step a) in dependence upon the heat generated by the engine less the heat dissipated by heat sinks.

11. A method according to claim 10, in which the heat sinks are one or more of auxiliary heaters, an exhaust gas recirculation unit, an oil cooler and a cabin heater.

* * * * *